United States Patent [19]

Deppe

[11] 4,222,735

[45] Sep. 16, 1980

[54] CYLINDRICAL ROTARY KILN WITH SATELLITE COOLING TUBES

[75] Inventor: Antonius Deppe, Neubeckum, Fed. Rep. of Germany

[73] Assignee: Polysius AG, Neubeckum, Fed. Rep. of Germany

[21] Appl. No.: 902,509

[22] Filed: May 3, 1978

[30] Foreign Application Priority Data

May 3, 1977 [DE] Fed. Rep. of Germany ..... 2719762

[51] Int. Cl.[2] ..... F27B 7/00

[52] U.S. Cl. ..... 432/80; 432/77

[58] Field of Search ..... 432/80, 77

[56] References Cited

U.S. PATENT DOCUMENTS

| | | | |
|---|---|---|---|
| 3,792,961 | 2/1974 | Theil | 432/80 |
| 3,811,824 | 5/1974 | Theil | 432/80 |
| 3,829,282 | 8/1974 | Deussner | 432/80 |

*Primary Examiner*—Henry C. Yuen

*Attorney, Agent, or Firm*—Jones, Thomas & Askew

[57] ABSTRACT

Satellite cooling tubes are mounted about a cylindrical rotary kiln, and funnel-shaped couplings connect one end of each cooling tube to the cylindrical kiln. A pair of cylindrical discharge spouts and connecting sockets are connected between the kiln and each of the funnel shaped couplings. The discharge spouts are arranged in an equally spaced annular array about the rotary kiln in two annular rows with the spouts of one row being offset circumferentially with respect to the spouts of the other row.

2 Claims, 3 Drawing Figures

CYLINDRICAL ROTARY KILN WITH SATELLITE COOLING TUBES

BACKGROUND OF THE INVENTION

This invention relates to a cylindrical rotary kiln with satellite cooling tubes of which the inlet ends are connected through funnel-shaped couplings to material discharge spouts of the kiln.

In practice, material discharge spouts generally substantially oval in cross-section are provided at the discharge end of a cylindrical rotary kiln. An oval material discharge spout of this type is then generally provided with a substantially circular connecting flange for receiving a compensator element.

Unfortunately, the production of oval discharge spouts involves relatively high manufacturing costs, relatively large kilns requiring correspondingly large oval discharge spouts which in turn require commensurate reinforcement and fairly considerable material thicknesses.

SUMMARY OF THE INVENTION

Accordingly, the object of the present invention is to provide a cylindrical rotary kiln of the type referred to above in which in particular the manufacturing costs of those parts situated in the transition zone from the actual cylindrical rotary kiln to the satellite cooling tubes are reduced.

According to the invention, this object is achieved in that two cylindrical material discharge spouts are provided for each satellite cooling tube.

According to the invention, therefore, the oval material discharge spouts hitherto used for the cylindrical rotary kiln are now replaced by two cylindrical material discharge spouts for each satellite cooling tube, the overall cross-section of these two cylindrical material discharge spouts naturally being selected large enough not to interferewith the discharge of material from the kiln into the corresponding satellite cooling tubes. Since a cylindrical material discharge spout is generally easier to manufacture than an oval material discharge spout and since in addition each of these cylindrical material discharge spouts is considerably smaller in cross-section than the oval construction hitherto used, it is possible to save considerably on manufacturing costs alone. Added to this, however, is the fact that, for static reasons, these smaller cylindrical material discharge spouts can be made with much thinner walls than the conventional oval discharge spouts without any adverse effect upon their stability so that further savings can be made.

The two material discharge spouts of each satellite cooling tube may be equal in diameter or even different in diameter, depending upon the particular application and the particular requirements.

In either case, it is of particular advantage for the two material discharge spouts to be staggered relative to one another both in the axial direction and also in the peripheral direction of the kiln shell in such a way that the material to be treated first enters a connecting socket situated at the outer end of the associated funnel-shaped coupling. In this way, it is possible to obtain a particularly reliable discharge of material from the actual cylindrical rotary kiln into the satellite cooling tubes.

This particular feature may be favourably supported by arranging all the material discharge spouts (looking in the peripheral direction of the kiln shell) in two parallel rows and at equal intervals from one another, the respectively adjacent material discharge spouts being staggered relative to one another.

BRIEF DESCRIPTION OF THE DRAWINGS

One example of embodiment of the invention is described in detail in the following with reference to the accompanying drawings, wherein.

DETAILED DESCRIPTION

Figure 1:
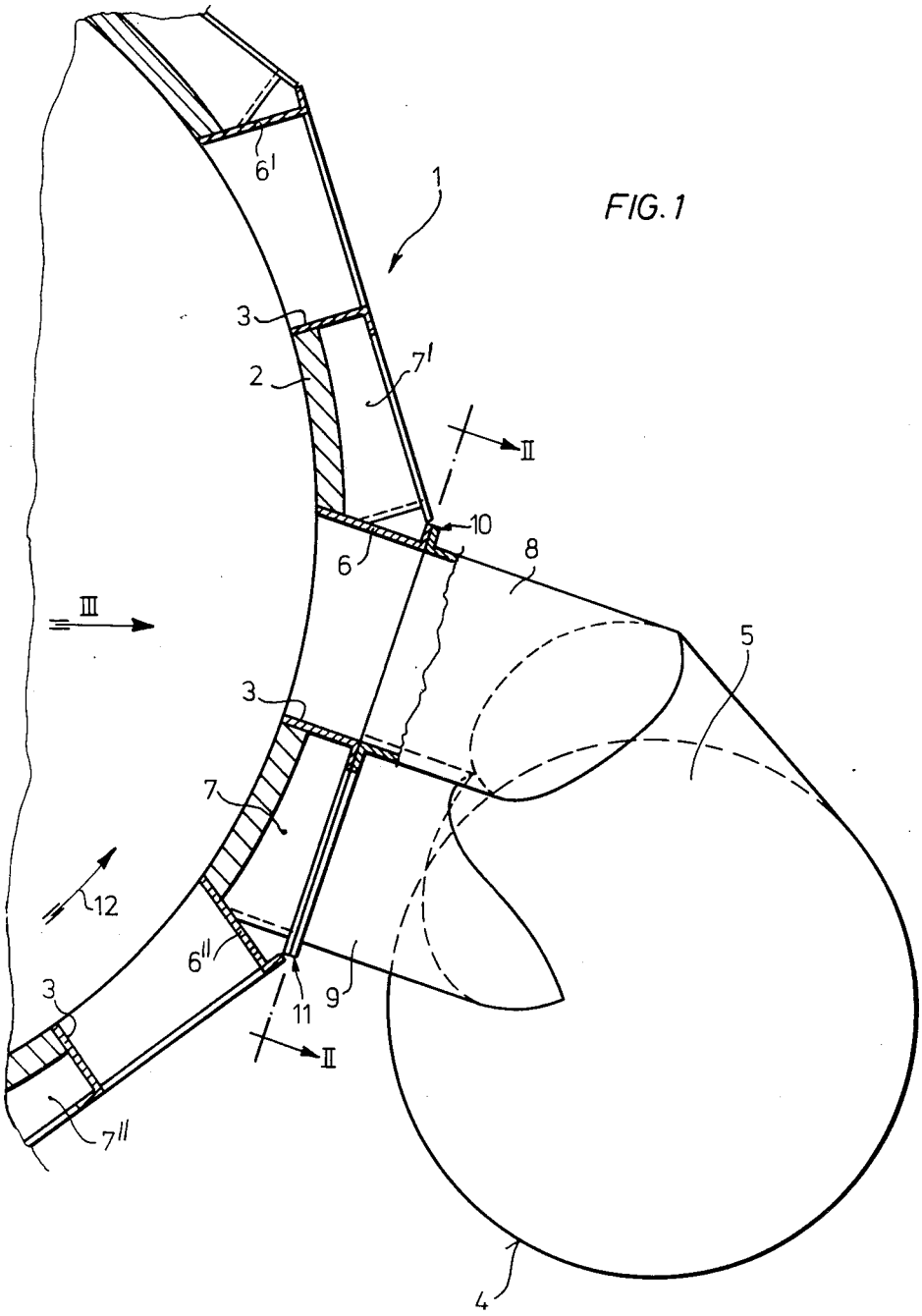
FIG. 1 is a cross-section through part of a cylindrical rotary kiln according to the invention in the vicinity of its material discharge end showing an attached satellite cooling tube.

In the interests of simplicity, FIG. 1 shows only part of the cylindrical rotary kiln 1 according to the invention, i.e. only part of the kiln shell 2 is shown in cross-section, this cross-section being taken through that part of the kiln which contains the material discharge openings 3 leading to the satellite cooling tubes 4 arranged at the discharge end of the kiln, of which only one is shown in the drawing, although of course a corresponding number is uniformly distributed in the usual way over the shell 2 of the cylindrical rotary kiln. A funnel-shaped coupling 5 is attached (preferably flanged) at one end onto the inlet end of each satellite cooling tube.

Figure 2:
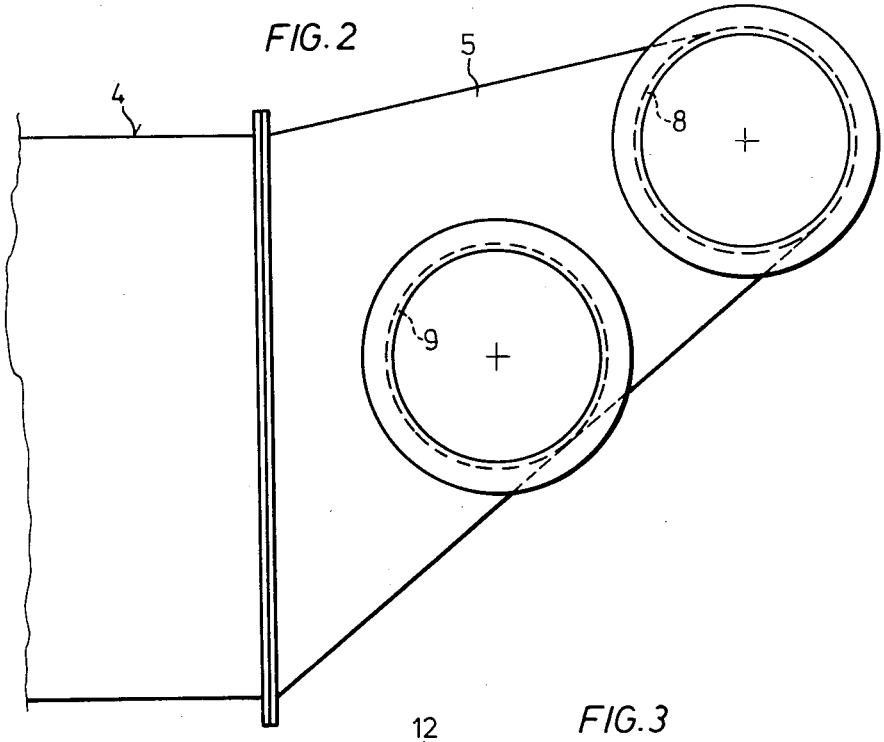
FIG. 2 is a partial elevation (on the line II—II in FIG. 1) of a satellite cooling tube attached to this cylindrical rotary kiln.

For each satellite cooling tube 4, the cylindrical rotary kiln 1 comprises two cylindrical material discharge spouts 6, 7 which are connected to two likewise cylindrical connecting sockets 8, 9 of the associated coupling 5, in the present case by flanges 10, 11 which are screwed in the usual way (not shown in detail). As can be seen in particular from FIG. 1, the straight material discharge spouts 6, 7 of circular cross-section with their associated connecting sockets 8 and 9 are aligned with one another. The two connecting sockets 8, 9 are arranged on the associated funnel-shaped coupling 5 of the satellite cooling tube 4 in such a way that one (in this case the connecting socket 8) is situated exactly at the tip of the funnel, i.e. at the outer end of the coupling 5, whilst the other (i.e. the connecting socket 9) is offset in the direction of the actual satellite cooling tube 4 and also in the peripheral direction of the coupling 5, although the two connecting sockets 8,9 extend substantially parallel to one another and substantially at a right angle relative to the satellite cooling tube 4 (cf. FIGS. 1 and 2).

Figure 3:
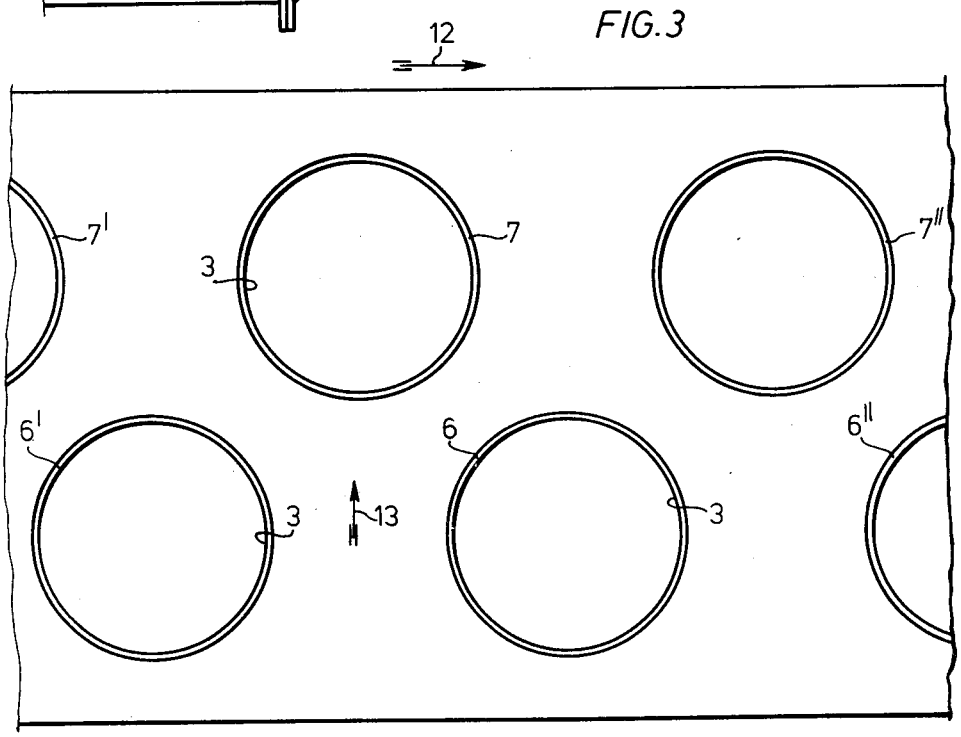
FIG. 3 is a partial developed projection through that part of the cylindrical rotary kiln in which the material discharge openings leading to the satellite cooling tubes are arranged (looking from inside the kiln, cf. arrow III).

Another important feature of the present invention is that the two material discharge spouts 6, 7 of the kiln 1 for one satellite cooling tube 4 are staggered relative to one another both in the axial direction and also in the peripheral direction of the kiln 1 in such a way that, when the kiln is rotating (cf. arrow 12), the material to be treated initially enters the connecting socket (8) situated at the outer end of the associated satellite cooling tube coupling 5, i.e. the material to be treated first enters the outlet opening 3 of the material discharge spout 6 and then the staggered spout 7. As can be seen in particular from FIG. 3, all the material discharge spouts 6, 7, 6′, 7′, 6″, 7″ are preferably arranged in two parallel rows and at equal intervals from one another in these rows (looking in the peripheral direction of the kiln shell 2), the adjacent material discharge spouts of both rows being staggered relative to one another, as can clearly be seen from the partial developed projection in FIG. 3. It can also be seen from FIG. 3 that the adjacent material discharge openings 3 of adjacent material discharge spouts slightly overlap one another in the projection of both rows so that, in view of the axial passage of the material (cf. arrows 13) through the cylindrical rotary kiln 1, a reliable discharge of material from the kiln into the satellite cooling tubes 4 is guaranteed.

In the embodiment shown by way of example in the drawing, the two material discharge spouts 6, 7 and also the two connection sockets 8, 9 for each satellite cooling tube 4 are equal in diameter, which provides for particularly easy production. In certain applications of a cylindrical rotary kiln, however, it can be of advantage for reasons associated with process technology for the two material discharge spouts associated with each satellite cooling tube and for the associated connecting sockets to differ in diameter.

I claim:

1. A cylindrical rotary kiln rotatable about its longitudinal axis, a plurality of satellite cooling tubes mounted in spaced relationship with respect to one another about said kiln and rotatable with said kiln, the improvement therein of at least two cylindrical material discharge spouts extending between said kiln and the inlet end portion of each said satellite cooing tubes, with the first ones of the cylindrical discharge spouts of the satellite cooling tubes being arranged in an equally spaced annular array about said rotary kiln and with the second ones of the cylindrical discharge spouts of the satellite cooling tubes being arranged in an equally spaced annular array about said rotary kiln, with the second ones of the cylindrical discharge spouts being offset longitudinally and circumferentially with respect to the first ones of the cylindrical discharge spouts.

2. The invention of claim 1 and further including a funnel shaped coupling for each of said satellite cooling tubes including an enlarged opening connected to one end portion of a satellite cooling tube and connected at its smaller end to one of said cylindrical discharge spouts and connected intermediate its ends to the other of said cylindrical discharge spouts.

* * * * *